US011646135B1

(12) United States Patent
Mutnury et al.

(10) Patent No.: US 11,646,135 B1
(45) Date of Patent: May 9, 2023

(54) HIGH PERFORMANCE DIFFERENTIAL CABLE

(71) Applicant: Dell Products L.P., Round Rock, TX (US)

(72) Inventors: Bhyrav Mutnury, Austin, TX (US); Sandor Farkas, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/452,591

(22) Filed: Oct. 28, 2021

(51) Int. Cl.
*H01B 17/14* (2006.01)
*H01B 19/00* (2006.01)
*H01B 11/00* (2006.01)

(52) U.S. Cl.
CPC ..... *H01B 17/14* (2013.01); *H01B 11/005* (2013.01); *H01B 19/00* (2013.01)

(58) Field of Classification Search
CPC ..... H01B 17/14; H01B 11/005; H01B 19/00
See application file for complete search history.

(56) References Cited

U.S. PATENT DOCUMENTS 5,574,250 A * 11/1996 Hardie ..... H01B 11/005 174/109
6,010,788 A * 1/2000 Kebabjian ..... H01B 11/002 174/105 R
6,091,025 A * 7/2000 Cotter ..... H01B 11/22 174/113 C
6,239,379 B1 * 5/2001 Cotter ..... H01B 11/06 174/113 C
6,403,887 B1 * 6/2002 Kebabjian ..... H01B 11/1025 174/113 R
9,928,943 B1 * 3/2018 McNutt ..... H01B 11/1016
2003/0150638 A1 * 8/2003 Patel ..... H01B 11/005 174/113 R
2007/0209823 A1 * 9/2007 Vexler ..... H01B 11/06 174/113 C
2009/0325397 A1 * 12/2009 Mizukami ..... H01R 13/6658 439/65
2010/0029104 A1 * 2/2010 Patel ..... H01R 13/6658 439/76.1
2012/0285723 A1 * 11/2012 Gundel ..... H01B 7/0823 174/113 R
2012/0302096 A1 * 11/2012 Ellison ..... H01R 13/6466 439/607.05
2013/0146326 A1 * 6/2013 Gundel ..... H01B 11/005 174/102 R
2013/0312992 A1 * 11/2013 Guetig ..... H01B 11/1891 174/34
2014/0069687 A1 * 3/2014 Tryson ..... H01B 17/14 264/166

(Continued)

*Primary Examiner* — Timothy J Thompson
*Assistant Examiner* — Rhadames Alonzo Miller
(74) *Attorney, Agent, or Firm* — McDermott Will & Emery LLP

(57) ABSTRACT

A high performance differential cable comprises a bulk differential cable formed with a dielectric core having a central cavity and a plurality of wire guides on the outer perimeter. A pair of differential signal conductors (DSC) may be divided into two sets of wires. The smaller wires provide higher signal transmission speeds with lower losses. A paddle board at each end of the bulk differential cable comprises an interconnecting structure for combining signals from the two sets of wires into the two DSCs.

16 Claims, 8 Drawing Sheets

(56) References Cited

U.S. PATENT DOCUMENTS

| | | | | |
|---|---|---|---|---|
| 2014/0202751 | A1* | 7/2014 | Bugg | H05K 1/117 174/75 R |
| 2014/0305676 | A1* | 10/2014 | Sugiyama | H01B 11/1839 174/102 R |
| 2015/0357095 | A1* | 12/2015 | Siripurapu | H01B 7/295 174/99 R |
| 2017/0301431 | A1* | 10/2017 | Li | H05K 9/0098 |
| 2018/0076555 | A1* | 3/2018 | Scholeno | H01R 13/6585 |
| 2018/0090243 | A1* | 3/2018 | Farkas | H01B 13/016 |
| 2018/0277285 | A1* | 9/2018 | Stilwell | H02G 3/30 |
| 2018/0294076 | A1* | 10/2018 | Farkas | H05K 1/112 |
| 2018/0366243 | A1* | 12/2018 | Farkas | H01B 11/20 |
| 2019/0066874 | A1* | 2/2019 | Kaczmarski | H01B 11/005 |
| 2019/0214162 | A1* | 7/2019 | Lee | H01B 11/04 |
| 2019/0318851 | A1* | 10/2019 | Doye | H02G 3/32 |
| 2020/0194911 | A1* | 6/2020 | Ayzenberg | H01R 13/6594 |
| 2020/0234854 | A1* | 7/2020 | McMeen | H01B 11/08 |
| 2020/0274267 | A1* | 8/2020 | Zerebilov | H01R 13/6581 |
| 2020/0403350 | A1* | 12/2020 | Hsu | H01R 13/631 |
| 2021/0408729 | A1* | 12/2021 | Peloza | H01R 13/6471 |
| 2022/0190513 | A1* | 6/2022 | Henry | H01R 13/6582 |

* cited by examiner

HIGH PERFORMANCE DIFFERENTIAL CABLE

BACKGROUND

Field of the Disclosure

This disclosure relates generally to information handling systems and, more particularly, to differential cables for communication between information handling systems.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Cables have become an integral part of server design. Within a server, cables connect PCBs. Within a rack, multiple servers may be installed and communication between servers and racks can occur over cables.

Cables provide a lower loss mode for signal propagation compared to PCB which makes them popular. Internal cables have been popular in rack servers for a while.

SUMMARY

Embodiments disclosed herein may be generally directed to a high performance differential signal cable and a method for manufacturing a high performance differential cable.

A method of manufacturing a high performance differential cable may comprise forming a dielectric core with a central cavity, a plurality of wire guides arranged on an outer perimeter and a polarity key located on the outer perimeter. The method further comprises positioning two sets of wires in the plurality of wire guides, wherein a first set of wires corresponds to a first differential signal conductor (DSC) and a second set of wires corresponds to a second DSC. The method also comprises surrounding the dielectric core and the plurality of wires with a dielectric layer and surrounding the dielectric layer with a shield to form a bulk differential cable. The method further comprises forming a paddle board with two pads on a first end and an interconnecting structure on a second end, the interconnecting structure configured for interconnecting the two or more wires of each DSC and isolating the two DSCs. The method may also include forming a slot in the dielectric core, positioning the paddle board in the slot, connecting a first wire of a first DSC to a first pad of the two pads, connecting a first wire of a second DSC to a second pad of the two pads, connecting a second wire of the first DSC to a first lead that is connected to the first pad, and connecting a second wire of the second DSC to a second lead that is connected to the second pad, wherein the interconnecting structure divides each pair of signals for transmitting through the first set of wires and the second set of wires and combines signals received from multiple wires into a single set of signals.

In some embodiments, the cavity comprises a plurality of sides based on a combined number of wires of the two DSCs. In some embodiments, the combined number of wires of the two DSCs is four and the cavity comprises four sides. In some embodiments, each side of the plurality of sides of the cavity is oriented relative to a wire guide of the plurality of wire guides. In some embodiments, the polarity key is located on the outer perimeter relative to the cavity.

In some embodiments, the interconnecting structure comprises a first pad for coupling to a first wire associated with a first DSC and a first lead, a first transverse member and a first crossover member for coupling to a second wire associated with the first DSC. The interconnecting structure may comprise a second pad for coupling to a first wire associated with a second DSC and a second lead, a second transverse member and a second crossover member for coupling to a second wire associated with the second DSC.

In some embodiments, a diameter of each wire is approximately half a diameter of a corresponding differential signal conductor.

In some embodiments, each wire extends outward of the outer perimeter and the dielectric layer contacts each wire such that a dielectric pocket is formed between the outer perimeter of the dielectric core and the dielectric layer.

BRIEF DESCRIPTION OF THE DRAWINGS

For a more complete understanding of the invention and its features and advantages, reference is now made to the following description, taken in conjunction with the accompanying drawings, in which.

DESCRIPTION OF PARTICULAR EMBODIMENT(S)

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and one or more video displays. The information handling system may also include one or more buses operable to transmit communication between the various hardware components.

Cables are used to connect information handling systems and cards or components on information handling systems.

Figure 1:
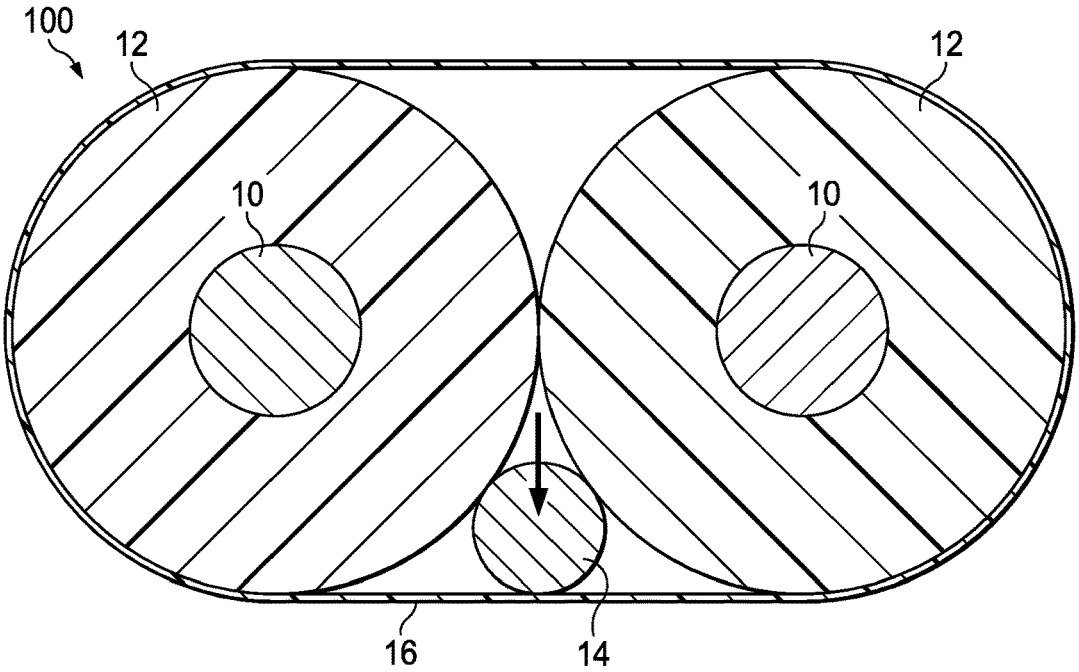
FIG. 1 is a cross-section view of a common cable for communicating between information handling systems.

Referring to FIG. 1, a typical cable 100 comprises two differential signal conductors 10, an insulator 12 surrounding each DSC 10, ground wire 14, all surrounded by shield 16. A pair of DSCs 10 may be referred to as a differential pair structure.

Traditional differential pair structures are coupled in one direction; either horizontally (edge coupled) or vertically (broadside coupled), which results in some fringing, since the electromagnetic fields use more space to terminate. This increases crosstalk and lowers density since it requires more space to isolate.

A challenge for server designs involves lowering the signal loss through cables. While ultra-low loss materials are being considered on one end, the materials add cost. Furthermore, even though cables provide a low loss medium, the loss is not adequate to address crosstalk concerns for cables with greater than 700 mm cable lengths. Due to the density of servers, increasing the size of the cables is undesirable and might not be a choice.

Particular embodiments are best understood by reference to FIGS. 2-8, 9A-9B and 10-13, wherein like numbers are used to indicate like and corresponding parts.

Figure 2:
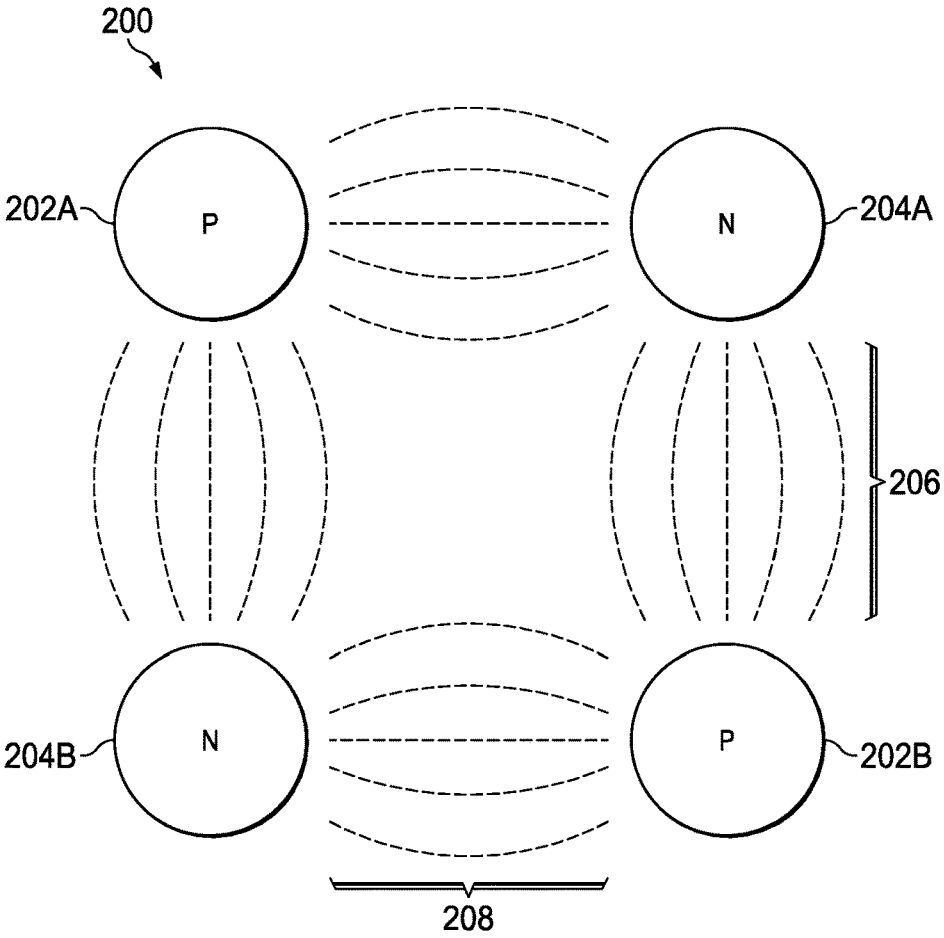
FIG. 2 is a cross-section view of a differential signal conductor separated into two pairs of differential signal conductors each, illustrating horizontal and vertical coupling that can cancel crosstalk between channels.

Referring to FIG. 2, embodiments disclosed herein may divide each DSC 10 into two or more interconnected wires 202A, 202B and 204A, 204B, whereby the outer diameter of a high performance differential cable is not increased (and may be decreased) but signal losses are reduced. As depicted in FIG. 2, the symmetry tightens up the coupling and reduces fringing, between fields 206, which results in lower crosstalk. As the number of conductors is doubled, loss is reduced as well, even when using thinner conductors. In cable applications the tight coupling allows drainless operation, and the low leakage enables a simple wrapped shield without having to worry about resonances.

Bulk Differential Cable

FIGS. 3-6 may be associated with steps in a manufacturing process for constructing a bulk differential cable. FIGS. 3-6 depict bulk differential cable 300 having two pairs of wires for a combined four total wires, but larger numbers are possible (and may have increasing performance capabilities).

Figure 3:
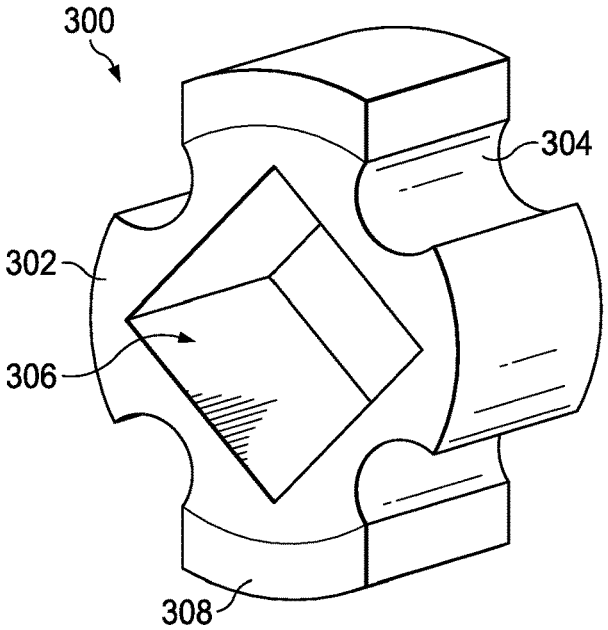
FIG. 3 is a perspective view of a dielectric core with a cavity, four wire guides and a polarity key according to one embodiment of a high-performance differential cable.

Referring to FIG. 3, manufacturing a bulk differential cable may start with extruding a dielectric core 302. Embodiments of dielectric core 302 may comprise a plurality of wire guides 304 on an outer perimeter of dielectric core 302, polarity key 308 and central cavity 306. Wire guides 304 may be formed as grooves configured to retain wires 202A, 202B, 204A and 204B during the build process.

Cavity 306 may comprise multiple sides. As depicted in FIG. 3, cavity 306 may have four sides. Cavity 306 having sides may be used as a tooling feature to align the end of bulk differential cable during cable termination to prepare bulk differential cable for coupling to a connector. Cavity 306 contains air, which reduces dielectric losses. Cavity 306 also makes bulk differential cable lighter and more flexible.

Polarity key 308 may be formed as a thicker section of dielectric core 302. Polarity keys 308 may be used for matching polarity of wires 202A, 202B, 204A and 204B and add mechanical strength of bulk differential cable for cable termination.

Figure 4:
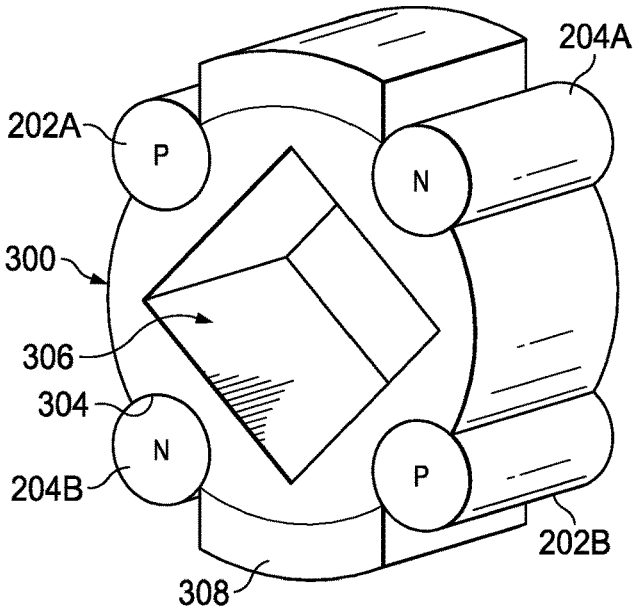
FIG. 4 is a perspective view of the dielectric core of FIG. 3 with two pairs of two wires positioned in the four wire guides according to one embodiment of a high-performance differential cable.

FIG. 4 depicts bulk differential cable 300 with wires 202A, 202B, 204A and 204B positioned in wire guides 304 of dielectric core 302. As depicted in FIG. 4, wires 202A, 202B, 204A and 204B may extend partially outward of an outer perimeter of dielectric core 302.

Figure 5:
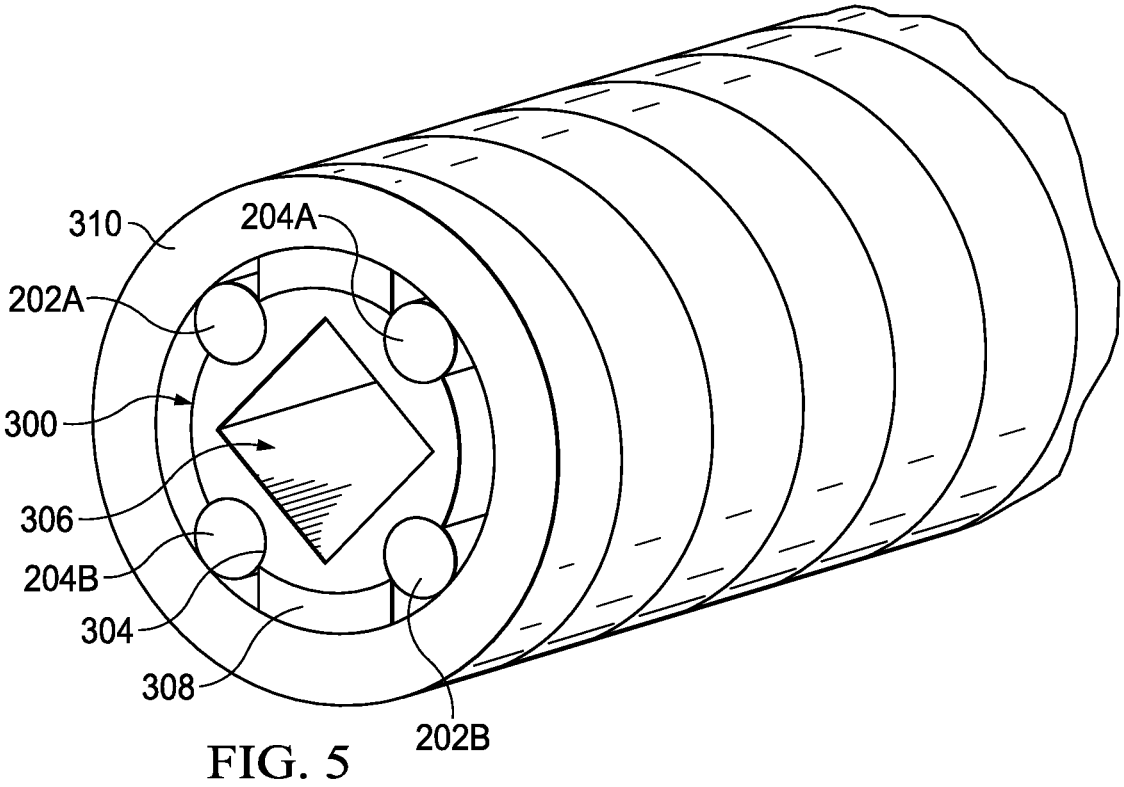
FIG. 5 is a perspective view of the dielectric core of FIG. 4 with a dielectric layer surrounding the dielectric core and the four wires to form a bulk differential cable according to one embodiment of a high-performance differential cable.

FIG. 5 depicts bulk differential cable 300 with wires 202A, 202B, 204A and 204B positioned in wire guides 304 of dielectric core 302 and dielectric layer 310 surrounding wires 202A, 202B, 204A and 204B and dielectric core 302. As depicted in FIG. 5, in some embodiments, dielectric layer 310 may contact wires 202A, 202B, 204A and 204B but not contact dielectric core 302 such that air may be present in spaces between wires 202A, 202B, 204A and 204B and dielectric layer 310. In some embodiments, dielectric layer 310 comprises a dielectric tape wrap.

Figure 6:
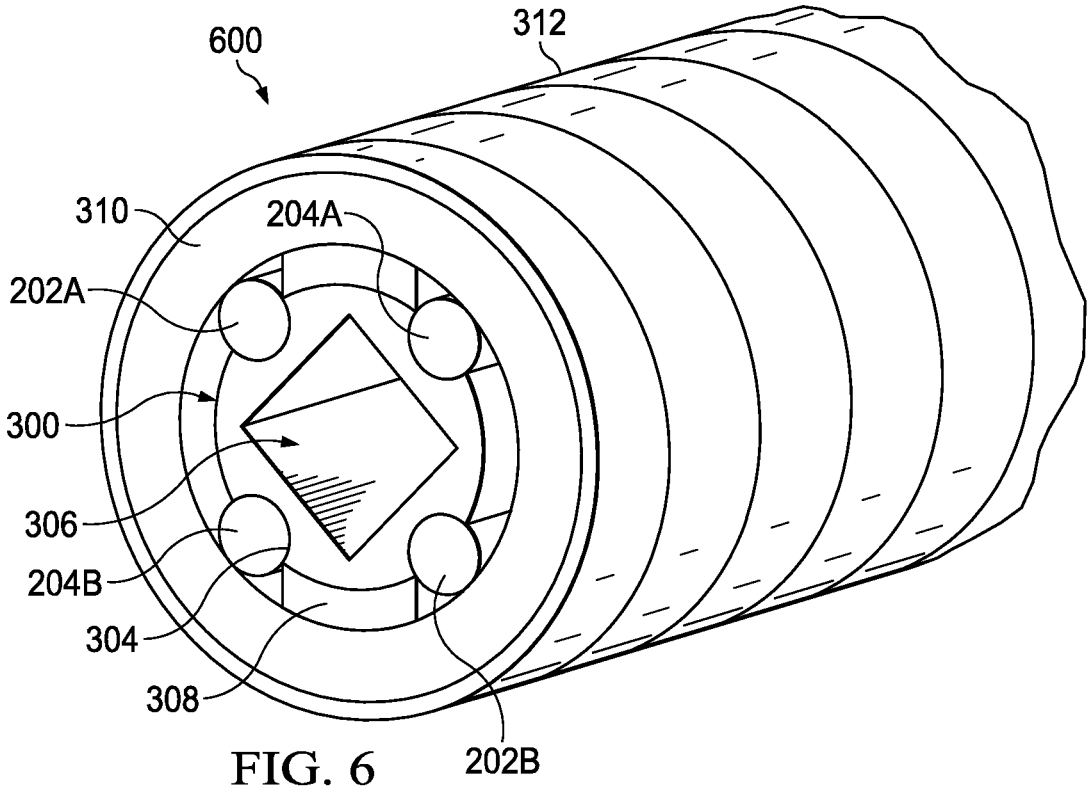
FIG. 6 is a perspective view of the bulk differential cable of FIG. 5 with a shield surrounding the dielectric layer according to one embodiment of a high-performance differential cable.

FIG. 6 depicts bulk differential cable 600 with wires 202A, 202B, 204A and 204B positioned in wire guides 304 of dielectric core 302, dielectric layer 310 surrounding wires 202A, 202B, 204A and 204B and dielectric core 302, and shield 312 surrounding dielectric layer 310. In some embodiments, because of the strong coupling and well contained fields, a simple foil wrap 312 may be sufficient.

Bulk Differential Cable Termination

FIGS. 7-8, 9A-9B and 10-11 depict embodiments of a high performance differential cable during various stages of cable termination in a manufacturing process.

Figure 7:
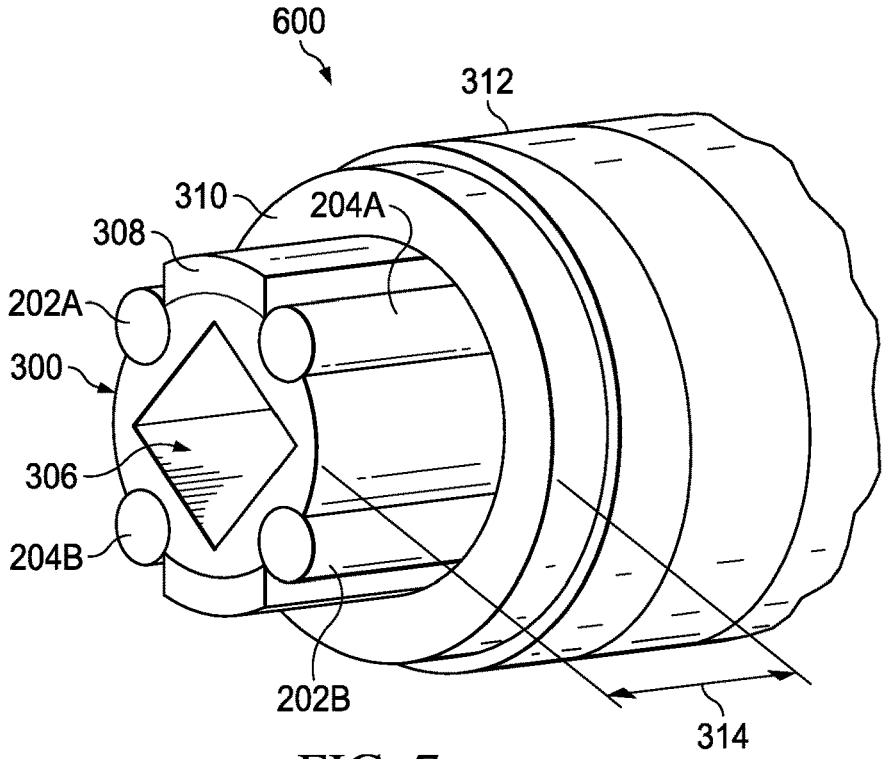
FIG. 7 is a perspective view of an end of the bulk differential cable of FIG. 6 with portions of the dielectric layer and shield removed from the bulk differential cable for manufacturing one embodiment of a high-performance differential cable.
Figure 8:
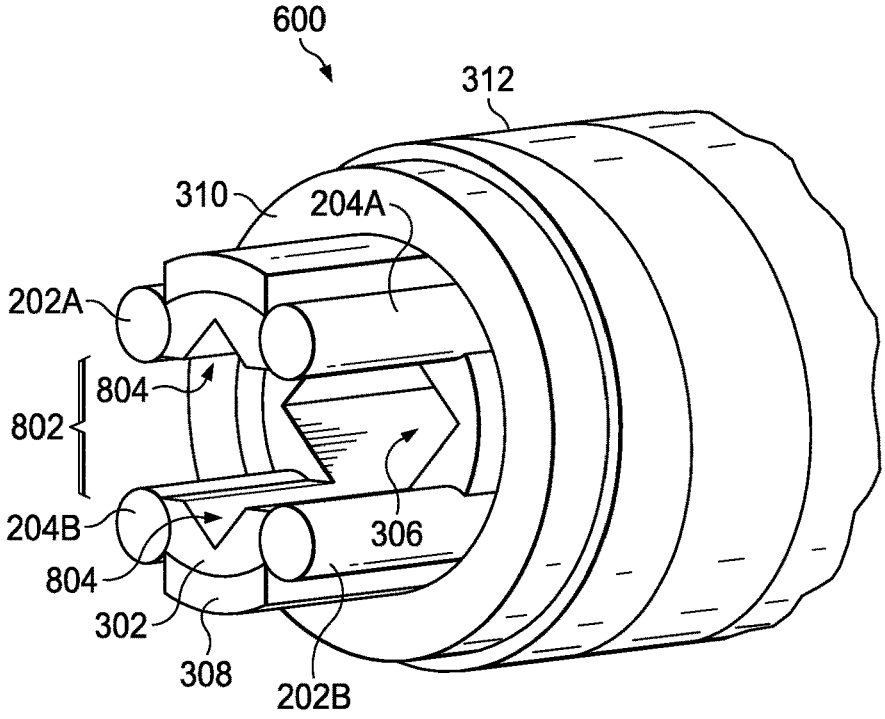
FIG. 8 is a perspective view of the bulk differential cable of FIG. 7 with a slot formed in the dielectric core for manufacturing one embodiment of a high-performance differential cable.

Referring to FIG. 7, slot 802 may be formed in an end of bulk differential cable 600. Shield 312 and dielectric layer 310 may be stripped a distance 314 to expose wires 202A, 202B, 204A and 204B. One or more of cavity 306 and polarity key 308 may be used to align each end of bulk differential cable 600 to a cutter such that, when slot 802 is formed, the same wires (e.g., wires 204A and 204B) are on the same side of slot 802. Additionally, when slot 802 is formed, dielectric spaces 804 may be retained between adjacent wires (e.g., wires 204A and 204B) on the same side of slot 802.

High Performance Cable End Connectors

FIGS. 9A, 9B, 10 and 11 depict views of high performance cable manufactured using bulk differential cable 600 and a paddle card interface with an interconnecting structure.

Figure 9A:
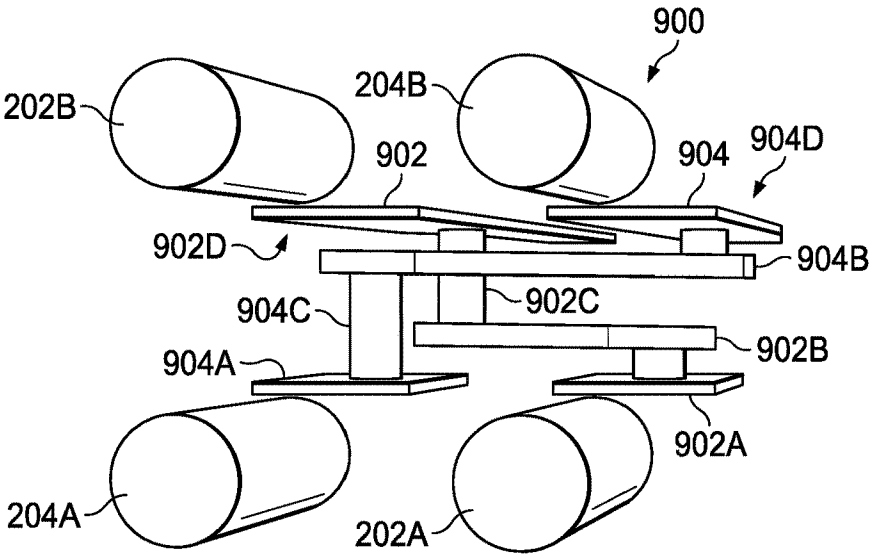
FIG. 9A is a perspective view of two pairs of two wires with an interconnect connecting each pair of wires for manufacturing one embodiment of a high-performance differential cable.
Figure 9B:
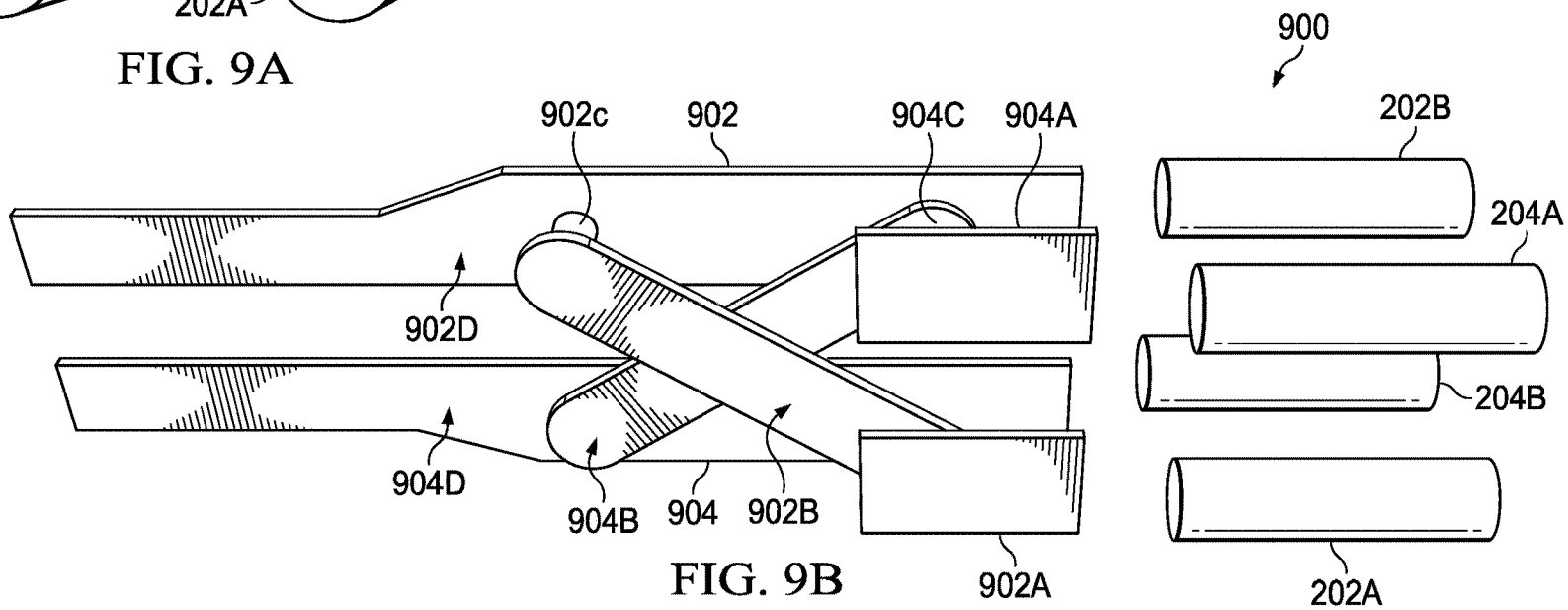
FIG. 9B is an alternate perspective view of two pairs of two wires with an interconnect connecting each pair of wires for manufacturing one embodiment of a high-performance differential cable.

FIGS. 9A and 9B depict images illustrating one strategy to combine four wires 202A, 202B, 204A and 204B into one pair of differential signal conductors 202, 204. As depicted in FIGS. 9A and 9B, interconnecting structure 900 comprises first pad 902 for coupling to a first wire (e.g., 202B) and second pad 904 for coupling to second wire (e.g., wire 204A). Additionally, first pad 902 may be coupled to a second wire (202A) through first lead 902A, first crossover member 902B and first transverse member 902C. Similarly, second pad 904 may be coupled to a second wire (204B) through second lead 904A, second crossover member 904B and second transverse member 904C. Thus, interconnecting structure 900 at a first end of bulk differential cable 600 may divide a single pair of signals for transmitting through multiple wires in bulk differential cable 600 and combine signals received from multiple wires in bulk differential cable 600 into a single pair of signals.

Figure 10:
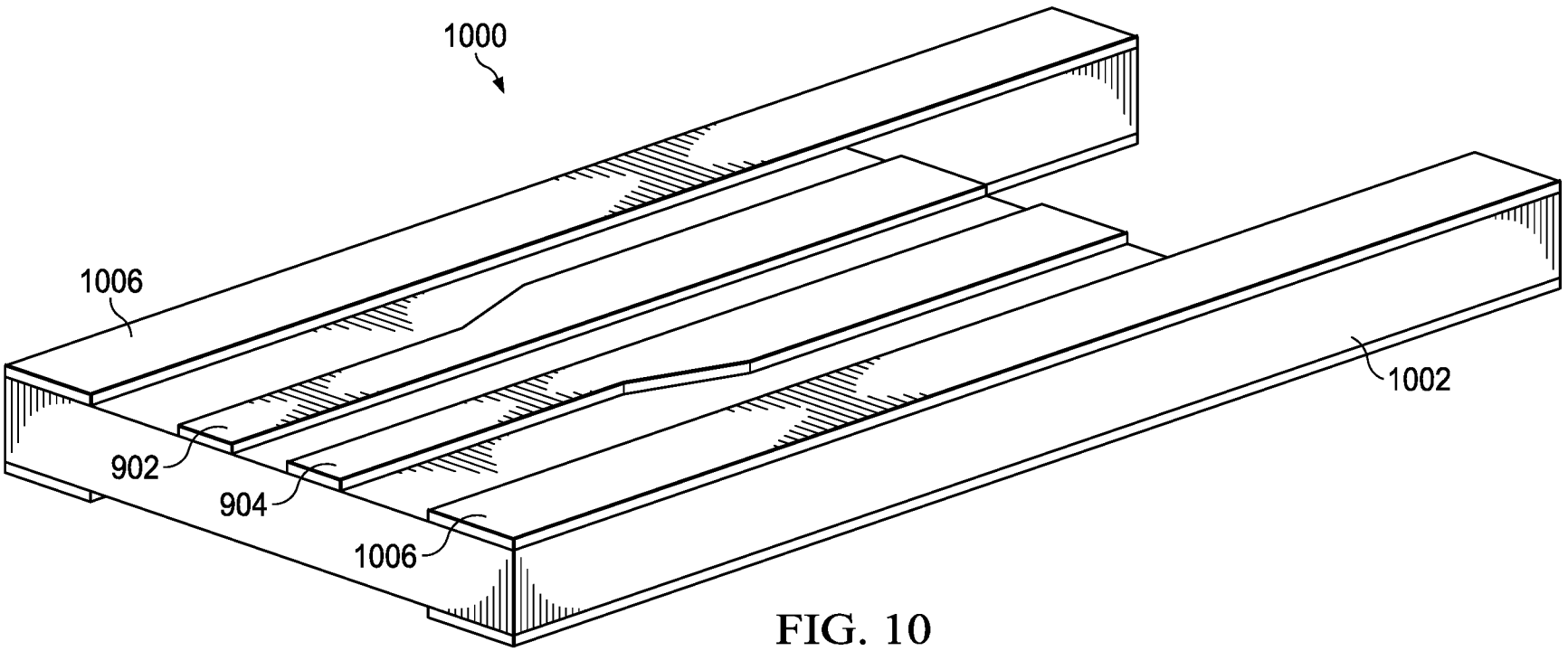
FIG. 10 is a perspective view of a paddle board with the interconnect of FIGS. 9A and 9B for manufacturing one embodiment of a high-performance differential cable.

FIG. 10 depicts one embodiment of paddle board 1000 comprising interconnecting structure 900. As depicted in FIG. 10, paddle board 1000 may comprise base 1002, first pad 902 for coupling to a first differential signal connector 202 (not shown), second pad 904 for coupling to a second differential signal connector 204 (not shown) and grounding pads 1006. Interconnecting structure 900 may be integrated with base 1002. Impedance and length matching all happens in paddle board 1000. Planes and GND vias are omitted for clarity.

Figure 11:
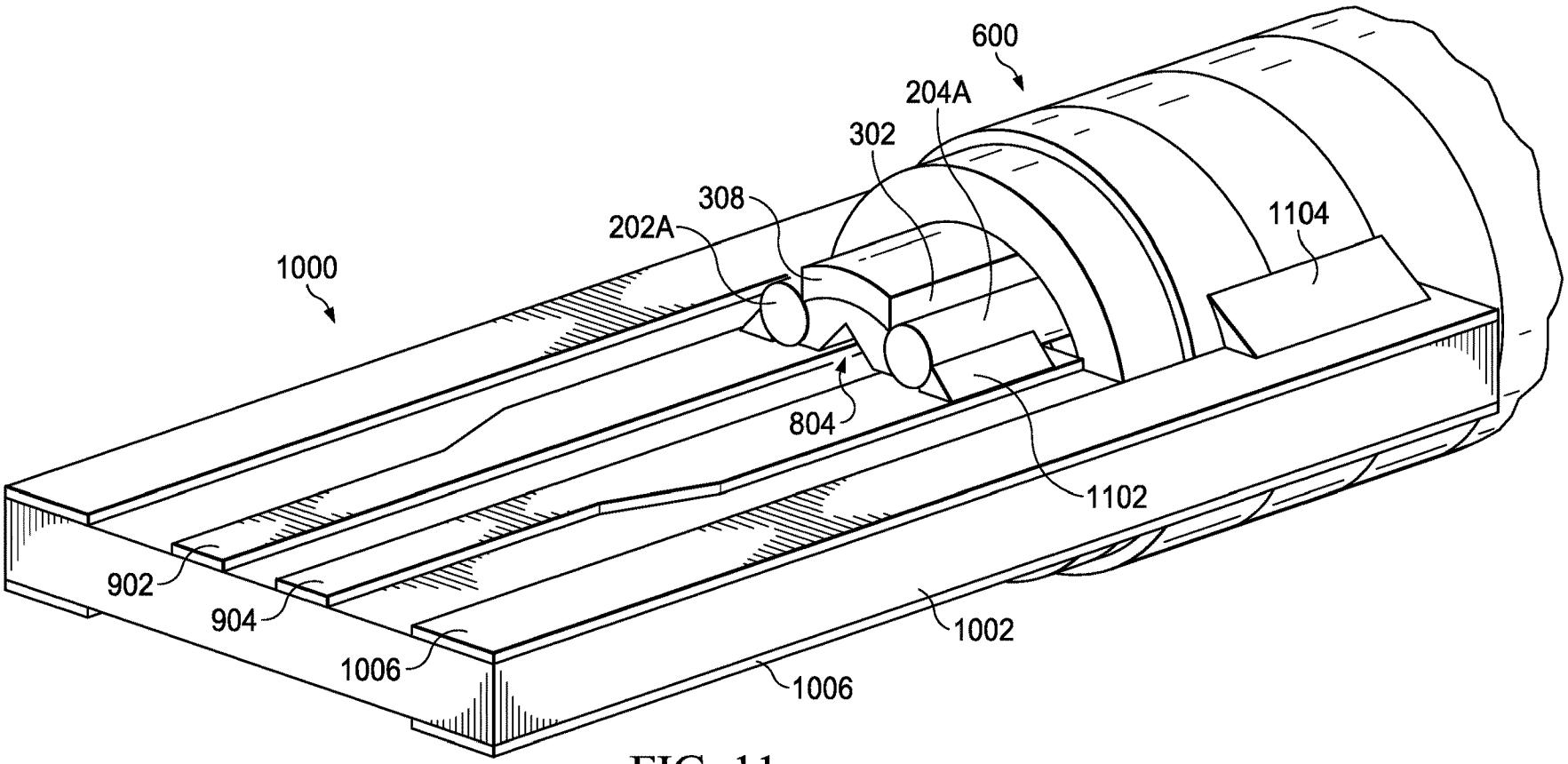
FIG. 11 is a perspective view of a paddle board connected to the bulk cable to form one embodiment of a high-performance differential cable.

FIG. 11 depicts a perspective partial view of one embodiment of an end of a high performance differential signal cable configured with paddle board 1000 positioned in slot 802 of bulk differential cable such that wires 202A, 202B (not visible), 204A, and 204B (not visible) are connected to one of first pad 902 or second pad 904. Solder 1102 may further couple wires 202A, 202B, 204A, and 204B to first pad 902 or second pad 904. Solder 906 may couple shield 312 to grounding pads 1006. Paddle board 1000 can be made compatible with all edge-based connector types such as high-speed signal conductors such as Mini Cool Edge 10 (MCIO) connectors, SATA interface connectors such as Slimline connectors and high volume universal connectors such as Gen-Z connectors.

In some embodiments (not shown) an overmold may be applied to the end of a high performance differential signal cable for mechanical strength and to protect the connections between wires 202A, 202B, 204A, and 204B and first pad 902 and second pad 904.

Figure 12:
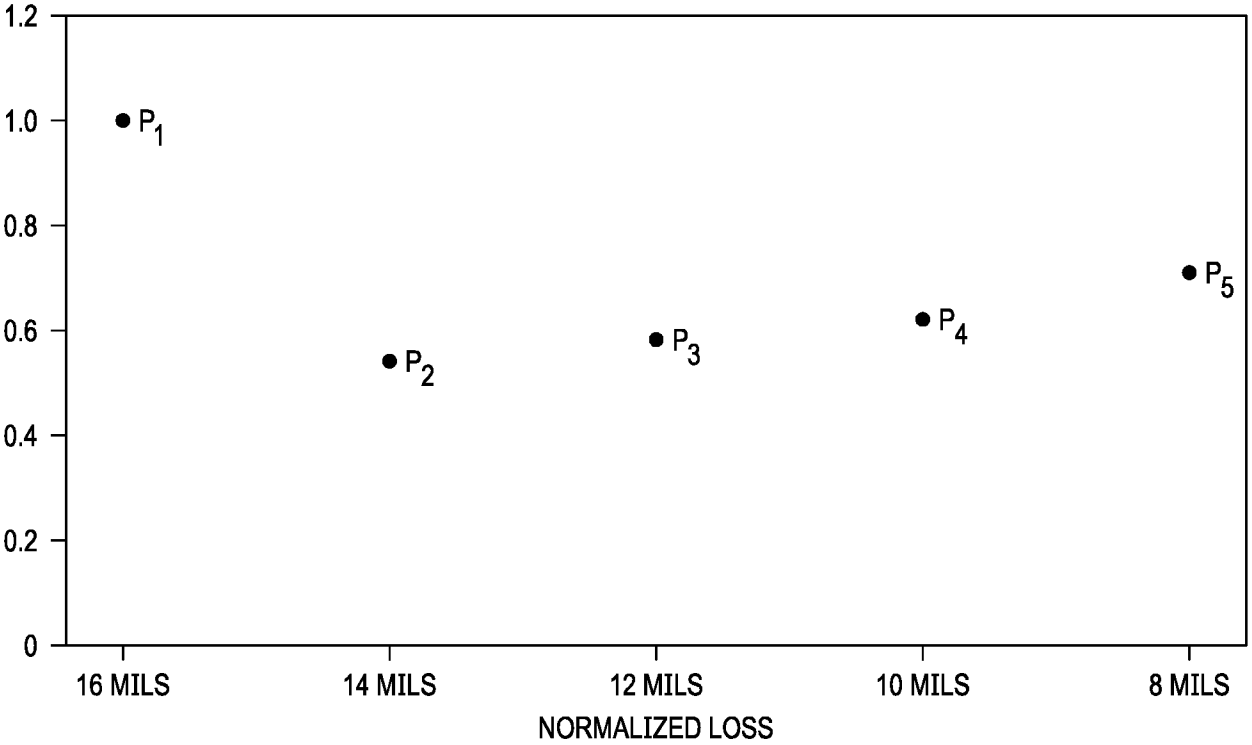
FIG. 12 is a graph depicting normalized losses for differential cables with wires of different diameters, illustrating benefits of one embodiment of a high-performance differential cable.

Referring to FIG. 12, air is the best medium for high-speed signals as it has Dk=1 and loss tangent of 0. Embodiments disclosed herein allow air to be present in cavity 306, between dielectric core 302 and dielectric shield 310, and spaces 804, which reduce signal loss drastically. The diameter of each wire 202A, 202B, 204A and 204B may be half the diameter of a differential signal conductor such as differential signal conductor 10 (shown in FIG. 1), which typically results in more signal losses of a high performance differential signal cable. However, having four wires instead of two increases the surface area and reduces skin effect losses, which results in a net improvement over two thicker wires. FIG. 12 depicts a graph of normalized losses for wires of different diameters. For example, point P1 represents a conductor (such as depicted in FIG. 1) with a diameter of 16 mils and normalized losses of 1. Points P2-P5 represent losses for wires of smaller diameters. For example, point P2 represents a conductor with a 14 mils diameter, resulting in normalized losses of 0.57. Many cables today are around 8-11 mils in diameter. Comparing the losses of a wire with an 8 mils diameter represented point P5 and the losses of a wire with for a wire with a 16 mils diameter represented by point P1, the losses represented by point P5 are about 30% lower. Thus, embodiments that use two smaller wires instead of a single large wire may have significantly lower losses. Notably, FIG. 12 depicts a simulation for a model that did not include air in air pockets or a dielectric core. Thus, for embodiments with air present, the losses associated with point P5 for a cable with 8 mils diameter as compared with point P1 for a cable with 16 mils diameter may be less than 30%.

Alternate Configurations

Figure 13:
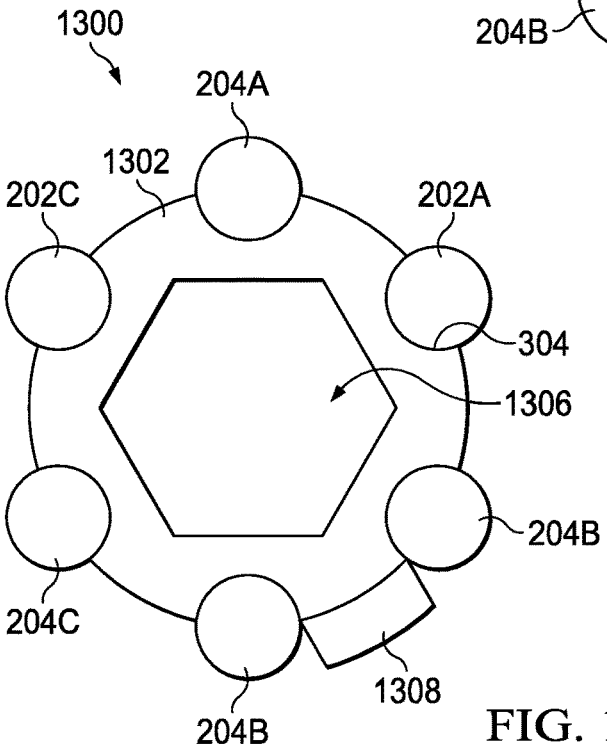
FIG. 13 is an end view of a dielectric core configured with two pairs of three wires positioned in six wire guides according to one embodiment of a high-performance differential cable.

Referring to FIGS. 4 and 13, embodiments may comprise two or more wires for each differential signal conductor. As mentioned above with respect to FIG. 4, embodiments may have two pairs of wires for a combined total number of four wires 202A, 202B, 204A and 204B. Embodiments may have more wires as well. As depicted in FIG. 13, embodiments may have two sets of three wires for a combined total number of six wires 202A, 202B, 202C, 204A, 204B and 204C. Dielectric core 1302 may be configured with six wire guides 1304 and cavity 1306 may have three or more sides. Dielectric key 1308 may be used for aligning dielectric core 1302 relative to a cutter.

The above disclosed subject matter is to be considered illustrative, and not restrictive, and the appended claims are intended to cover all such modifications, enhancements, and other embodiments which fall within the true spirit and scope of the disclosure. Thus, to the maximum extent allowed by law, the scope of the disclosure is to be determined by the broadest permissible interpretation of the following claims and their equivalents, and shall not be restricted or limited by the foregoing detailed description.

What is claimed is:

1. A high performance differential cable, comprising:

a dielectric core comprising:

a central cavity;

a plurality of wire guides arranged on an outer perimeter; and a polarity key located on the outer perimeter;

two differential signal conductors (DSC)s, wherein each DSC comprises two or more wires, each wire positioned in one of the wire guides;

a dielectric layer surrounding the dielectric core and the two or more wires for each differential signal conductor;

a shield surrounding the dielectric layer; and a paddle board comprising:

two pads on a first end; and an interconnecting structure on a second end, the interconnecting structure configured for interconnecting the two or more wires of each DSC and isolating the two DSCs.

2. The high performance differential cable of claim 1, wherein the cavity comprises a plurality of sides based on a combined number of wires of the two DSCs.

3. The high performance differential cable of claim 2, wherein the combined number of wires of the two DSCs is four and the cavity comprises four sides.

4. The high performance differential cable of claim 2, wherein each side of the plurality of sides of the cavity is oriented relative to a wire guide of the plurality of wire guides.

5. The high performance differential cable of claim 2, wherein the polarity key is located on the outer perimeter relative to the cavity.

6. The high performance differential cable of claim 1, wherein the interconnecting structure comprises:

a first pad for coupling to a first wire associated with a first DSC;

a first lead, a first transverse member and a first crossover member for coupling to a second wire associated with the first DSC;

a second pad for coupling to a first wire associated with a second DSC;

a second lead, a second transverse member and a second crossover member for coupling to a second wire associated with the second DSC.

7. The high performance differential cable of claim 1, wherein a diameter of each wire is approximately half a diameter of a corresponding differential signal conductor.

8. The high performance differential cable of claim 1, wherein each wire extends outward of the outer perimeter; and the dielectric layer contacts each wire such that a dielectric pocket is formed between the outer perimeter of the dielectric core and the dielectric layer.

9. A method of manufacturing a high performance differential cable, the method comprising:

forming a dielectric core comprising:

a central cavity;

a plurality of wire guides arranged on an outer perimeter; and a polarity key located on the outer perimeter;

positioning two sets of wires in the plurality of wire guides, wherein a first set of wires corresponds to a first differential signal conductor (DSC) and a second set of wires corresponds to a second DSC;

surrounding the dielectric core and the plurality of wires with a dielectric layer;

surrounding the dielectric layer with a shield;

forming a paddle board comprising:

two pads on a first end; and an interconnecting structure on a second end, the interconnecting structure configured for interconnecting the two or more wires of each DSC and isolating the two DSCs;

forming a slot in the dielectric core;

positioning the paddle board in the slot; and connecting a first wire of a first DSC to a first pad of the two pads;

connecting a first wire of a second DSC to a second pad of the two pads;

connecting a second wire of the first DSC to a first lead that is connected to the first pad; and connecting a second wire of the second DSC to a second lead that is connected to the second pad, wherein the interconnecting structure divides each pair of signals for transmitting through the first set of wires and the second set of wires and combines signals received from multiple wires into a single set of signals.

10. The method of claim 9, wherein forming the cavity comprises forming a plurality of sides based on a combined number of wires of the two DSCs.

11. The method of claim 10, wherein the combined number of wires of the two DSCs is four and the cavity comprises four sides.

12. The method of claim 9, wherein forming the cavity comprises orienting each side of the plurality of sides of the cavity relative to a wire guide of the plurality of wire guides.

13. The method of claim 9, further comprising aligning the bulk differential cable relative to a cutter based on the polarity key.

14. The method of claim 9, wherein forming the interconnecting structure comprises:

positioning the first pad on a base;

coupling the first pad to one or more of a first transverse member and a first crossover member for connecting the first lead to the first pad;

positioning the second pad on a base;

coupling the second pad to one or more of a second transverse member and a second crossover member for connecting the second lead to the second pad.

15. The method of claim 9, wherein each wire comprises a diameter approximately half a diameter of a corresponding differential signal conductor.

16. The method of claim 9, wherein each wire extends outward of the outer perimeter; and surrounding the dielectric layer around the dielectric core contacts the dielectric core with each wire such that a dielectric pocket is formed between the outer perimeter of the dielectric core and the dielectric layer.

* * * * *